US005230263A

United States Patent [19]

Kwaka

[11] Patent Number: 5,230,263

[45] Date of Patent: Jul. 27, 1993

[54] WRENCH FOR USE ON THREADED PARTS THAT ARE NOT EASILY ACCESSIBLE

[76] Inventor: Cas Kwaka, 1908 Home Ave., Thunder Bay, Ontario, Canada, P7E 3C4

[21] Appl. No.: 941,702

[22] Filed: Sep. 8, 1992

[51] Int. Cl.[5] ..... B25B 13/02

[52] U.S. Cl. ..... 81/125.1; 81/124.3; 81/177.8; 81/177.7; 81/180.1

[58] Field of Search ..... 81/177.8, 177.9, 177.7, 81/119, 121.1, 180.1, 125.1, 124.3

[56] References Cited

U.S. PATENT DOCUMENTS

| | | | |
|---|---|---|---|
| 1,352,461 | 9/1920 | Lenholt | 81/125.1 |
| 1,413,243 | 4/1922 | Thompson | 81/125.1 |
| 1,936,352 | 11/1933 | Dixon | 81/125.1 |
| 2,426,763 | 9/1947 | Curtis | 81/177.8 X |
| 2,769,360 | 11/1956 | Cottrell et al. | 81/124.3 |
| 2,774,259 | 12/1956 | Caulkins | 81/124.3 X |

*Primary Examiner*—D. S. Meislin
*Attorney, Agent, or Firm*—Norman B. Rainer

[57] ABSTRACT

A hand tool for turning threaded machine nuts and bolts that are not easily accessible is constructed having an elongated shank portion having first and second extremities. An open-ended box wrench head is associated with the first extremity. A socket wrench is pivotably associated with the second extremity. A first retainer plate having an elongated receiving slot is disposed upon the box wrench head. A second retainer plate is disposed upon the socket wrench on the same side of the shank portion as the first retainer plate.

1 Claim, 2 Drawing Sheets

WRENCH FOR USE ON THREADED PARTS THAT ARE NOT EASILY ACCESSIBLE

BACKGROUND OF THE INVENTION

1. Field of the Invention

This invention concerns a hand tool for turning threaded machine nuts and bolts and more particularly concerns a wrench for engaging nuts and bolts that are either not easily accessible or cannot be visually observed.

2. Description of the Prior Art

Wrenches have earlier been disclosed for use on machine bolts that cannot be directly viewed by the mechanic or other person utilizing the wrench. Such devices are designed to grip a nut or the head of a machine bolt, said nut or head having a square or hexagonal shape. By virtue of specialized design features, such devices enable the mechanic to reach and turn nuts and bolts that would be otherwise inaccessible because of either tight quarters or obscured view.

U.S. Pat. No. 4,718,316, for example, discloses an attachment for a common wrench, said attachment having a magnetic head which facilitates the starting of nuts upon bolts positioned in a location inaccessible for both hands of the person using the wrench.

U.S. Pat. No. 4,406,188 discloses a nut-holding attachment for an open-end wrench with fixed jaws, and is designed to prevent the wrench from falling off a nut or bolt during tightening.

U.S. Pat. No. 4,901,608 discloses a ratchet wrench having a pivoted head which permits adjustability of the angle of the head relative to the handle of the wrench.

Although such earlier devices find specialized uses in certain specific applications, they lack versatility in coping with the general problem of manipulating inaccessible threaded members.

It is accordingly an object of the present invention to provide a hand tool for securely engaging and rotatively manipulating threaded members that cannot be directly seen or are not accessible to both hands of the mechanic utilizing the tool.

Further objects of this invention are to provide a tool of the aforesaid nature of durable, rugged construction, easy to use, and amenable to low cost manufacture.

These and other beneficial objects and advantages will be apparent from the following description.

SUMMARY OF THE INVENTION

The above and other beneficial objects and advantages are accomplished in accordance with the present invention by a hand-operable tool for gripping polygonally shaped threaded fastener components, said tool comprised of:

a) an elongated shank portion having first and second extremities and opposed substantially flat upper and lower faces, b) an open-ended box wrench head having fixed parallel jaws associated with said first extremity as a continuous integral extension of said shank portion, c) a first retainer plate disposed upon said box wrench head and provided with an elongated receiving slot, d) a socket wrench pivotably associated with said second extremity and sized so as to be capable of gripping threaded fastener components of the same size as those grippable by said box wrench head, and e) a second retainer plate disposed upon said socket wrench.

In preferred embodiments of the invention, both retainer plates are disposed above the same face of said shank portion. The socket wrench may be provided with a ratchet mechanism.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
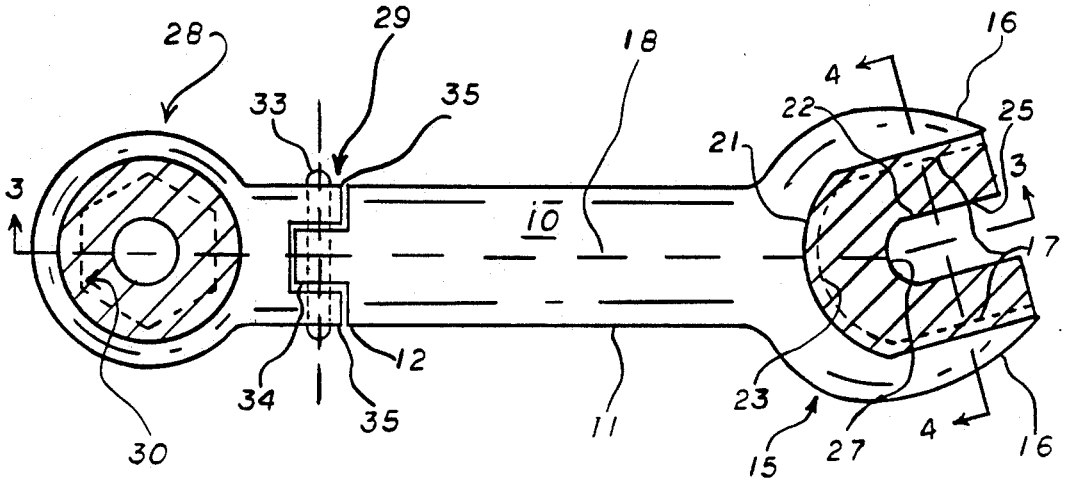
FIG. 1 is a top plan view of an embodiment of the tool of the present invention.
Figure 2:
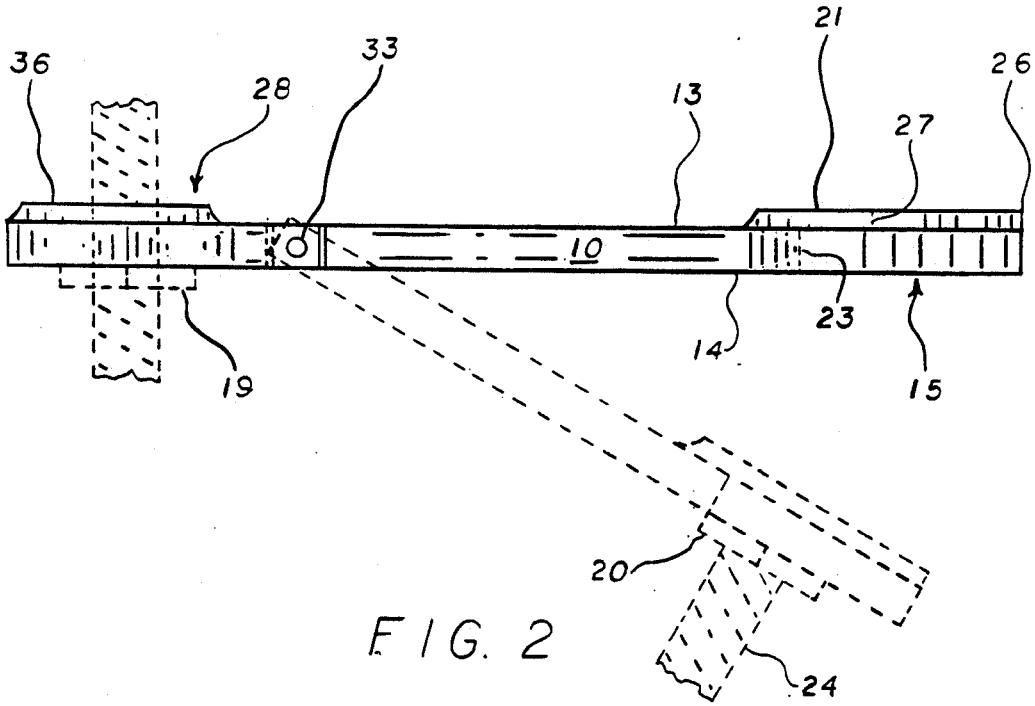
FIG. 2 is a side view of the embodiment of FIG. 1 showing in phantom outline a second configuration and functionally engaged nuts and bolts.
Figure 3:
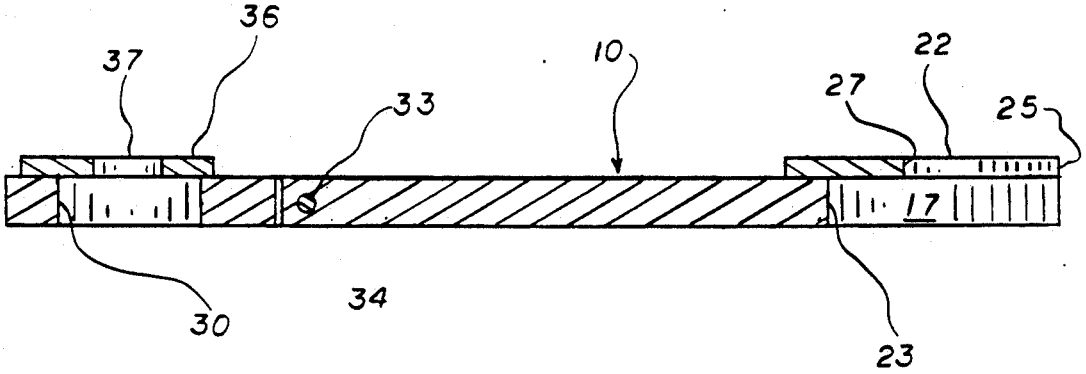
FIG. 3 is a sectional view taken in the direction of the arrows upon the line 3—3 of FIG. 1.
Figure 4:
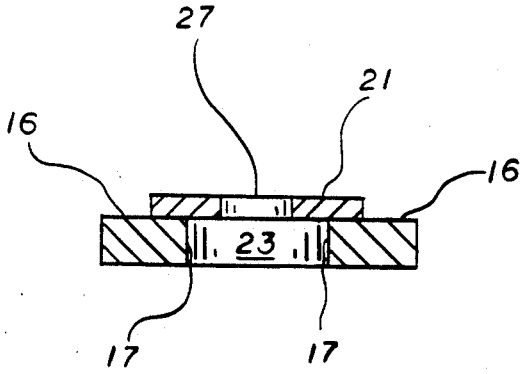
FIG. 4 is a sectional view taken in the direction of the arrows upon line 4—4 of FIG. 1.

Referring to FIGS. 1–4, an embodiment of the tool of the present invention is shown comprised of shank portion 10 elongated upon center axis 18 between first and second extremities 11 and 12, respectively, and bounded by opposed substantially flat upper and lower faces 13 and 14, respectively.

Open-ended box wrench head 15 is associated with said first extremity as a continuous integral extension of said shank portion. Head 15 is comprised of fixed jaws 16 defining receiving opening 25. Said jaws have parallel flat gripping surfaces 17 angularly disposed to axis 18, and separated by connecting surface 23. The spacing between said gripping surfaces is such as to correspond to the distance between opposed flat sides of a conventionally sized polygonal (square or hexagonal) threaded fastener component such as a nut 19 or head 20 of threaded bolt 24.

A first retainer plate 21 is disposed upon wrench head 15. An elongated slot 22 in plate 21 is centered above and between gripping surfaces 17. Said slot has an open forward extremity 26 and closed proximal extremity 27 having a semi-circular contour and disposed forwardly of the underlying connecting surface 23.

A socket wrench 28 is associated with second extremity 12 by way of frictionally restrained pivot means 29. Said socket wrench is comprised of aperture 30 whose perimeter contains uniformly spaced angled recesses 31 having apices 32. The distance between diagonally opposed apices is such that they will engage the corners of a nut or bolt whose flat side edges will fit closely within the fixed jaws of wrench head 15. In some embodiments, aperture 30 may be a ring member adapted to rotate within bearing means, said rotation being controllable by a ratchet device.

Pivot means 29 is comprised of pin 33 that penetratively engages holding lug 34 protruding from shank portion 10 and bifurcated holding yoke 35 integral with socket wrench 28. The pivot means is fashioned in a manner such that pivoted movement is frictionally restrained by the interaction of the several component members.

A second retainer plate 36 is disposed above aperture 30 and centered thereupon. Plate 36 contains circular hole 37 in coaxial alignment with the center of aperture 30. The purpose of hole 37 is to permit passage of bolts that are being serviced. Plate 36 may be either attached to socket wrench 28 or may be a continuous integral extension thereof, fabricated by a molding operation.

By virtue of the aforesaid components and their interaction, a mechanic who would utilize the tool of this invention has the ability to reach and manipulate threaded fastener components that are otherwise inaccessible. The adjustable angular relationship of the shank with respect to either wrench extremity functions in concert with the retainer plates to enable threaded members to be gripped and rotated even though they may not be visible to the mechanic.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A hand-operable tool for gripping polygonally shaped threaded fastener components, said tool comprised of:

a) an elongated shank portion having first and second extremities and opposed substantially flat upper and lower faces, b) an open-ended box wrench head having fixed parallel jaws associated with said first extremity as a continuous integral extension of said shank portion, said jaws defining a receiving opening having parallel flat gripping surfaces angularly disposed to the axis of elongation of said shank portion and separated by a connecting surface, c) a first retainer plate disposed upon said box wrench head and provided with an elongated receiving slot centered above and between said gripping surfaces and having an open forward extremity and a closed proximal extremity having a semi-circular contour disposed forwardly of the underlying connecting surface, d) a socket wrench associated with said second extremity by way of frictionally restrained pivot means permitting movement of said socket wrench in a path normal to the plane of said shank portion, said socket wrench having an aperture containing angled recesses, and sized so as to be capable of gripping threaded fastener components of the same size as those grippable by said box wrench head, and e) a second retainer plate disposed upon said socket wrench upon the same face of said shank portion upon which said first retainer plate is disposed, said second retainer plate containing a circular hole in coaxial alignment with said aperture.

* * * * *